United States Patent [19]

Danna et al.

[11] 4,070,266

[45] Jan. 24, 1978

[54] CONNECTION MEANS FOR ANODE POSTS AND CONDUCTORS TO ELECTROLYTIC CELLS

[75] Inventors: Peter A. Danna, Milford; Richard D. Burt, Westport, both of Conn.

[73] Assignee: Olin Corporation, New Haven, Conn.

[21] Appl. No.: 422,211

[22] Filed: Dec. 6, 1973

[51] Int. Cl.[2] ..... C25B 1/26

[52] U.S. Cl. ..... 204/266

[58] Field of Search ..... 204/242, 258, 266, 279, 204/252

[56] References Cited

U.S. PATENT DOCUMENTS

| | | | |
|---|---|---|---|
| 850,867 | 4/1907 | Finlay | 204/258 |
| 1,002,989 | 9/1911 | Heltzen | 204/258 |
| 1,898,352 | 2/1933 | Enzor | 204/258 |
| 3,432,422 | 3/1969 | Currey | 204/258 |
| 3,515,661 | 6/1970 | Coulter | 204/286 X |
| 3,591,483 | 7/1971 | Loftfield et al. | 204/266 X |
| 3,743,592 | 7/1973 | Metcalfe | 204/266 |

FOREIGN PATENT DOCUMENTS

| | | | |
|---|---|---|---|
| 868,516 | 4/1971 | Canada | 204/266 |
| 1,127,484 | 9/1968 | United Kingdom | 204/266 |

*Primary Examiner*—Charles F. LeFevour

*Attorney, Agent, or Firm*—Bruce E. Burdick; Donald F. Clements; Thomas P. O'Day

[57] ABSTRACT

An improved means for connecting anode posts and conductors to diaphragm cells is described which utilizes a conductor comprised of a pair of split and spaced-apart copper bars having a series of pairs of adjacent round grooves, each pair of grooves being adapted to receive an anode post. The pair of bars is firmly secured to the anode posts by bolting each pair of bars together.

A laminated cell base is employed comprised of a non-metallic corrosion resistant upper layer, such as rubber, secured to a lower metallic supporting layer such as steel.

Sealing means are provided between a dished washer on the anode post and the upper layer, and between the anode post and wall of the cell base hole in the lower layer.

12 Claims, 4 Drawing Figures

CONNECTION MEANS FOR ANODE POSTS AND CONDUCTORS TO ELECTROLYTIC CELLS

This invention relates to an electrolytic diaphragm cell having improved connection means for conductors and anode posts.

Electrolytic cells have been used extensively in the preparation of chlorine and caustic by the electrolysis of brine in a number of different cell designs. One of the problems in all of these designs is to provide a satisfactory means for conducting current from the ambient side or exterior surface of the electrolytic cell, through the cell base or wall to the anolyte container of the cell.

One type of cell design, the electrolytic diaphragm cell, was typically constructed of a steel cell can or body, a concrete top, and a concrete base. Graphite anodes were secured with lead and an asphaltic sealer in the cell base, and steel mesh cathodes coated with an asbestos diaphragm were suspended from the sides of the cell body. Recently the graphite anodes have been replaced by metallic electrodes having a suitable conducting coating on the outer surface of the anodes. It is preferable not to use lead to support these metallic anodes, which are sometimes referred to as "dimensionally stable anodes" because the conducting surface coating of the electrodes may become contaminated. As a result of this and the desire to improve electrical connections to these new metallic anodes, the structure of the conventional electrolytic diaphragm cell had to be modified in order to permit an improved installation of the dimensionally stable anodes.

U.S. Pat. No. 2,799,643, issued to C. W. Raetzsch on July 16, 1957, discloses a cell design for passing current to anodes secured to the sides of the cell container. This patent discloses cell bodies constructed of various non-conductive materials such as rubber covered steel.

U.S. Pat. No. 3,591,483, issued July 6, 1971 to Loftfield et al, describes a cell modification in which the cell base is a laminate of an electrically non-conductive sheet covering a metallic conducting and supporting cell base. Holes for receiving anode posts were formed in the cell base, the threaded anode posts were extended through the cell base and secured thereto with threaded nuts.

Although designs such as these represent an improvement over conventional concrete diaphragm cells, one of the problems which may occur in utilizing a flexible material as an upper layer of the cell bottom is that the flexible material may creep near anode post connections and produce an uneven interior surface of the cell bottom which is subject to erosion during extended operation. Furthermore, alignment of holes in flexible layer and rigid layer components of a laminated cell base is sometimes difficult to obtain.

In addition, satisfactory current distribution is not always obtained with presently known conductor connections.

There is a need at the present time for an improved means for connecting conductors and anode posts to electrolytic diaphragm cells.

It is a primary object of this invention to provide an improved conductor connection for electrolytic diaphragm cells.

Another object of the invention is to provide an improved electrolytic diaphragm cell in which anodes can be easily replaced or positioned within the cell.

Still another object of the invention is to provide a novel means for connecting anode posts in electrolytic diaphragm cells.

These and other objects of the invention will be apparent from the following detailed description thereof.

It has now been discovered that the foregoing objects of the invention are accomplished when the improvement of this invention is employed in an electrolytic diaphragm cell comprised of a laminated cell base, a cell body secured to the cell base, a plurality of diaphragm coated cathodes secured to the cell body, a plurality of metallic anodes having a conductive metal surface secured to an anode post, and a conductor means secured to each anode post. The improvement of this invention, in a broad aspect when applied to an electrolytic diaphragm cell, is comprised of the combination of a. a conducting means comprised of a pair of split and spaced-apart bars,
b. having a series of pairs of adjacent grooves,
   1. each pair of grooves being adapted to receive an anode post,
c. each pair of bars being firmly secured to the anode posts by securing each pair of bars together.

In a more limited aspect, the improvement of this invention, when applied to an electrolytic diaphragm cell is comprised of a. a cell base constructed of a laminated cell base comprised of a non-metallic corrosion-resistant upper layer secured to a lower metallic supporting layer,
b. the laminated cell base having a separate hole for receiving each anode post, each hole being aligned in at least one straight row,
c. each hole being lined with a sleeve of corrosion resistant material, the sleeve being preferably flanged on the upper hand
d. each anode post extending through one of the cell base holes and having a flange such as a dished washer secured substantially perpendicular thereto above the flanged sleeve,
e. a conducting means secured to each anode post positioned in each straight row below the lower layer,
f. said conducting means being comprised of a pair of split and spaced apart bars,
g. having a series of pairs of adjacent grooves adapted for receiving each anode post,
h. said pair of split bars being spaced-apart around and firmly secured to the anode posts by securing each pair of bars together,
i. sealing means positioned between each dished washer and the flanged sleeve, and
j. sealing means positioned between each anode post and a recess in the lower portion of the anode post adjacent to the flanged sleeve in the cell base hole receiving the anode post.

Figure 1:
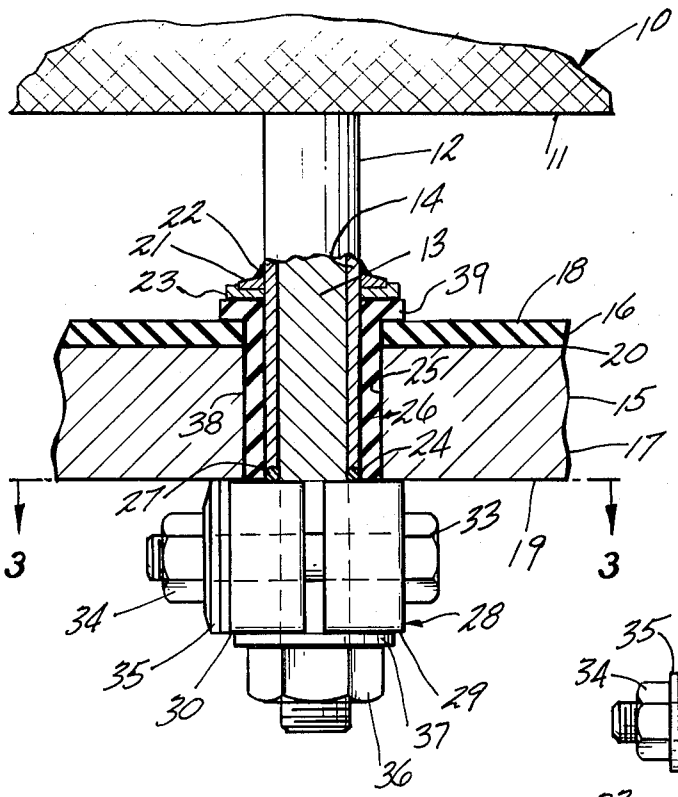
FIG. 1 is a sectional elevation view of one embodiment of the invention in which the conducting means is secured to the anode posts directly below the lower layer of the cell base.

More in detail, FIG. 1 shows anode 10 comprised of metal surface 11 and anode rod 12. Metal surface 11 may be a solid sheet or a mesh comprised of a titanium base coated with at least one metal and/or oxide of a platinum group metal such as platinum or ruthenium oxide. However, other suitable metals, metal oxides, and mixtures thereof useful as these metal surfaces are well known in the art.

Anode rod 12 is comprised of core 13 clad with exterior sheet 14. Usually anode core 13 is constructed of aluminum, copper, iron, steel and the like and is clad with an exterior sheet 14 of corrosion resistant metal such as titanium. Although titanium is generally utilized for cladding to exterior sheet 14 other suitable metals of construction which resist corrosion by the brine include tantalum, columbium and zirconium.

Cell base 15 is a laminated cell base comprised of a non-metallic corrosion resistant upper layer 15 secured to a lower metallic supporting layer 17.

The non-metallic corrosion resistant upper layer 16 has an interior surface 18 which serves as the floor of the cell to contain the electrolyte. The non-metallic corrosion resistant upper layer 16 may be constructed of hard rubber, polyethylene, chlorinated polyvinyl chloride, polypropylene, acrylonitrile-butadiene-styrene polymers (ABS), with or without fiber glass reinforcement fillers, polymerized fluorinated ethylene, polyester, mixtures thereof and the like. A coating of hard rubber is preferably used as upper layer 16.

Lower metallic supporting layer 17 has an exterior surface 29, and is constructed of aluminum, copper, iron, alloys of at least one of these metals, and the like. Steel is preferably used as layer 17, which is joined at interface 20 with a suitable cement (not shown) which provides a corrosion resistant bond over substantially the entire area of contact between upper layer 16 and lower layer 17. Exterior surface 19 is generally exposed to the atmosphere.

Anode rod 12 extends through cell base hole 25 in cell base 15. Cell base hole 25 is lined with a flanged sleeve 26 having a sleeve porition 38 and a flange portion 39. Flanged sleeve 26 is constructed of a corrosion resistant material of the type used for upper layer 16. Sleeve portion 38 is cemented to the wall of cell base hole 25 and the bottom of flange poriton 39 is cemented to the upper layer 16 in the same or similar manner as upper layer 16 is joined to lower layer 17 with a suitable corrosion resistant cement (not shown) with or without steam curing. Flanged sleeve 26 prevents any electrolyte from reaching the wall of cell hole 25 in cell base 15.

If desired, flanged portion 39 may be omitted and sleeve portion 38 is cemented to the wall of cell base hole 25 in upper layer 16 and lower layer 17.

The thickness of sleeve portion 38 and, if used, flange portion 39, may be varied, and depends on the size of the anode post holes. Generally, the thickness of these portions varies from about $\frac{1}{8}$ inch to about $\frac{1}{4}$ inch.

Dished washer 21 or other suitable flange is secured to anode rod 12 by welding 22 or other convenient means. Positioned between the upper portion of flanged portion 39 and dished washer 21 is upper sealing means 23. Dished washer 21 is constructed of titanium or other corrosion resistant material which can be easily secured to exterior sheet 14. Upper sealing means 23 is constructed of a corrosion resistant material having some flexibility such as polypropylene, neoprene, and the fluorinated hydrocarbons sold under the trademarks TEFLON and HYPALON.

Although anode rod 12 extends through cell base 15, a portion of exterior sheet 14 and if necessary, a portion of core 13 is removed from anode rod 12 in order to provide an O-ring recess 24 between core 13 of anode rod 12 and the internal wall of sleeve portion 38 in lower layer 17 of cell base 15. At least one O-ring 27 is positioned in O-ring recess 24. O-ring 27 is utilized as a lower sealing means and is usually constructed of the same type of flexible material described above for use as in upper sealing means 23. O-ring 27 provides a second sealing means to prevent electrolyte from reaching the conductor means, thereby preventing premature corrosion.

Conducting means 28 is comprised of a pair of split spaced-apart bars 29 and 30. Bars 29 and 30 each contain a series of round grooves 31 and 32, respectively, adjacent and opposite each other for holding anode cores 13. Threaded bolts 33 pass through holes in bars 29 and 30 and are secured to threaded nuts 34 and washer 35. Tightening of threaded nuts 34 increases the tightness of the grip of bars 29 and 30 on anode cores 13. Threaded lock nut 36 and lock washer 37 are secured to the lower threaded end of anode rod 12 and tightened until upper sealing means 23 is compressed, for example, about 25 percent of its height by dished washer 21. It is preferred to initially place bars 29 and 30 around the anode posts and loosely tighten with threaded nuts 34 prior to tightening threaded lock nut 36. After tightening threaded lock nut 36 sufficiently to obtain a liquid tight seal with upper sealing means 23 and force the top of conducting means 28 against exterior surface 19, then threaded nuts 34 are tightened to obtain a strong grip of bars 29 and 30 on anode cores 13.

If during the course of refurbishing the cell it is necessary to replace anode 10, it is a relatively simple matter to loosen threaded nut 34, remove lock washer 37 and threaded lock nut 36, remove anode 10 from the cell, and replace with a new anode 10, followed by tightening of threaded nut 34 and threaded lock nut 36.

Figure 2:
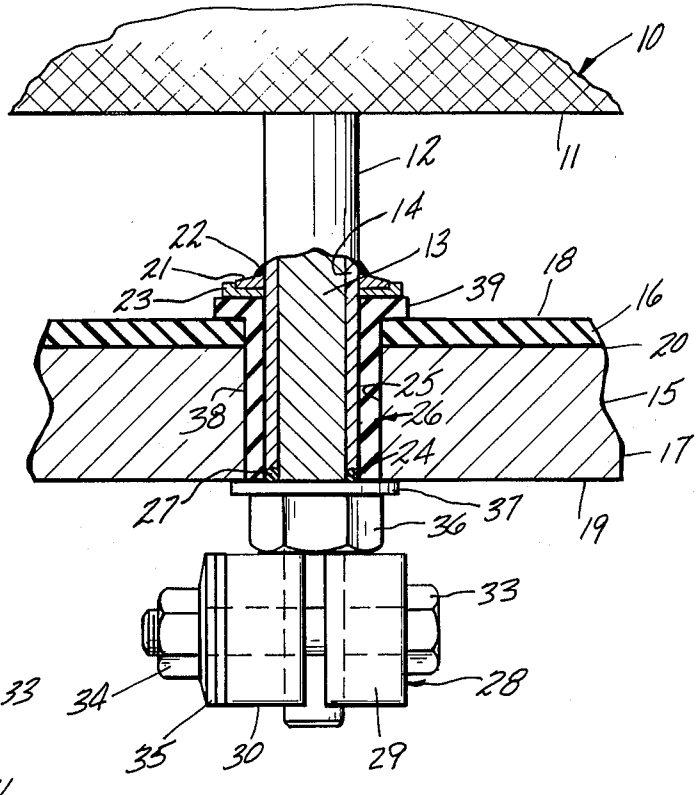
FIG. 2 is a sectional elevation view of another embodiment of the invention in which the conducting means is secured to the anode post below threaded nuts which are secured to the anode posts below the lower layer of the cell base.

FIG. 2 describes another embodiment of the invention, utilizing all of the components shown in FIG. 1, except that threaded lock nut 36 and lock washer 37 are not positioned below conducting means 28, but instead are positioned directly below exterior surface 19 of the lower layer 17 of cell base 15.

Figure 3:
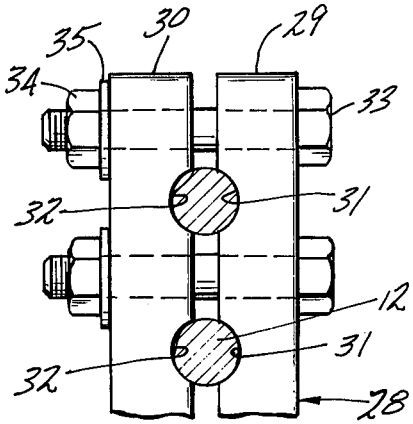
FIG. 3 is a sectional plan view of the anode assembly through lines 3—3 of FIG. 1 showing the means for securing the split bar conductor to the anode posts.

FIG. 3 is a sectional plan view through lines 3—3 of FIG. 1 showing split spaced-apart bars 29 and 30 having a series of pairs of round grooves 31 and 32, respectively. Anode rods 12 are secured to the round grooves 31 and 32 in bars 29 and 30, respectively, by tightening of threaded bolts 33 with threaded nuts 34.

Figure 4:
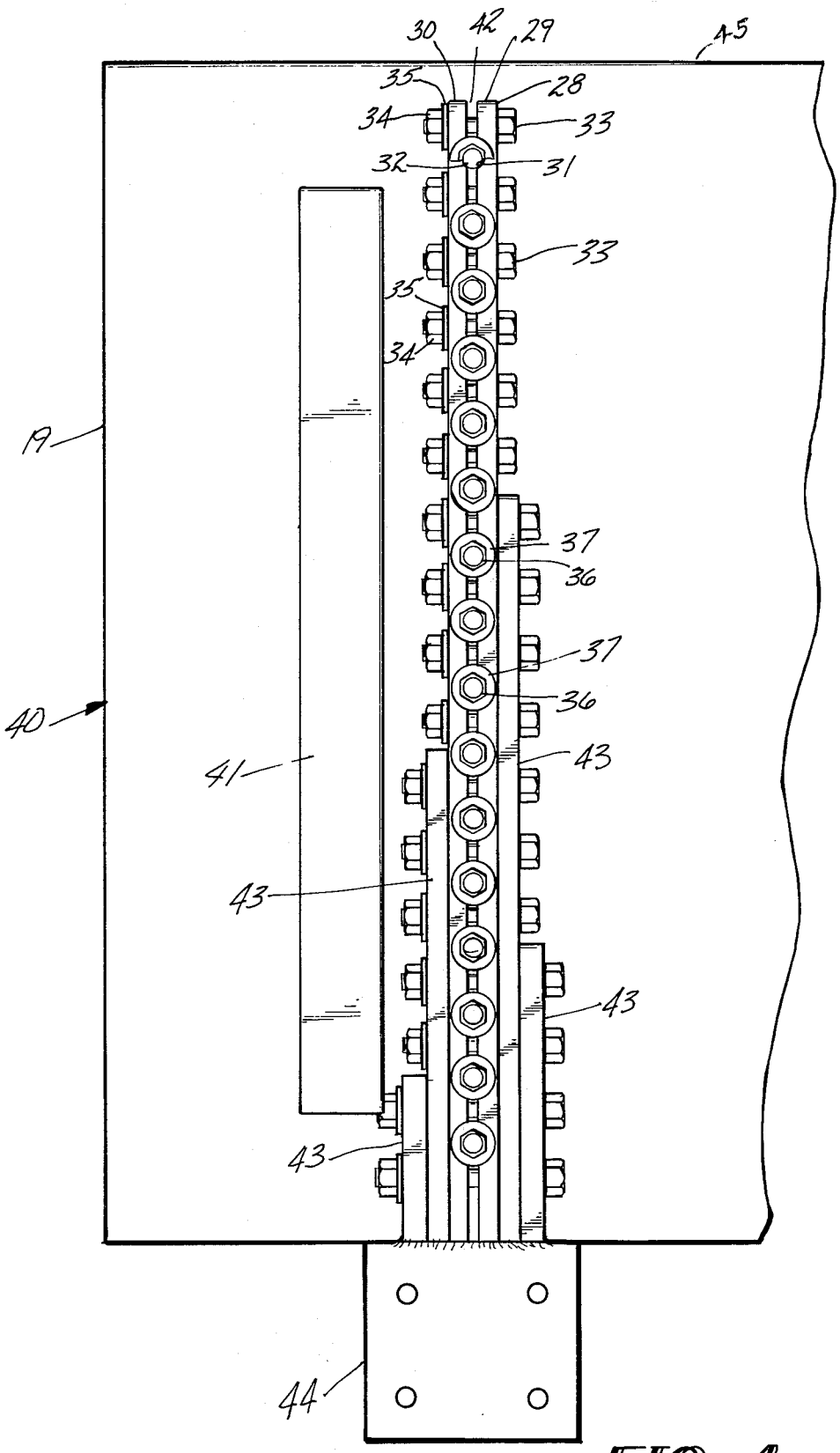
FIG. 4 is a partial bottom view of an embodiment of this invention showing a split bar conductor and conductor current leaf arrangement.

FIG. 4 is a partial bottom view of an electrolytic diaphragm cell 40 having exterior surface 19 and support 41 secured thereto. Support 41 is generally one of several supports positioned on the bottom of electrolytic cell 40 to provide a supporting foundation for the cell 40. The number and size of supports 41 will vary with the size and shape of electroytic diaphragm cell 40.

Extending through cell base holes 25 (not shown) in straight row 42 is a row of anode posts 12. Secured to each anode post 12 in straight row 42 is a conducting means 28 comprised of a pair of split and spaced-apart bars 29 and 30. Bars 29 and 30 have a series of pairs of round grooves 31 and 32, respectively, positioned adjacent and opposite to each other along the length of the split bars corresponding to the location of anode posts 12. Threaded bolts 33 having threaded nuts 34 and washers 35 are positioned along the pair of split bars 29 and 30 in between each anode post 12. Secured to the bottom of each end of post 12 is threaded lock nut 36 and lock washer 37.

In order to provide a substantial uniform current density in anode posts 12 extending throughout straight row 42, conductor current leaves 43 are secured in decreasing thickness from the bus bar attachment 44 to the opposite side 45 of electrolytic diaphragm cell 40. As a result, when bus bar attachment 44 is secured to an operative bus bar (not shwon) and current is fed to conducting means 28, a relatively uniform current density is achieved in anode posts 12 across straight row 42.

The number of conductor means 28 utilized in each electolytic diaphragm cell 40 will depend on the number of straight rows 42 of anode posts 12 in cell 40, which will vary with the size and shape of the electrolytic diaphragm cell employed.

The relative thickness of upper layer 16 and lower layer 17 may also be varied with the size and shape of the electrolytic diaphragm cell 40. In a typical cell design, the upper layer 16 is about ¼ inch thick and the lower layer 17 is about one inch thick. However, the thickness of the upper layer 16 may range from about ⅛ inch to about one inch and the lower layer 17 may range about ½ inch to about two inches or more. Thicknesses which provide the desired degree of support without undue expense are usually employed.

Various modifications may be made in the invention without being outside the scope of the invention. For example, anode rods 12 have been illustrated and described as being cylindrical, having threaded ends and being fastened to the cell by means of threaded lock nuts. It will be recognized by those skilled in the art that bars which are rectangular, square or of other cross sectional area may be used instead of cylindrical rods. Other means such as clamps, welding and the like may be used to replace the threaded anode nuts and washer. The "round groove" in the split bars may be modified to conform with the cross sectional area of the anode posts in order that a maximum degree of contact between the posts and the conducting means is obtained. In addition, the conducting means 28 is preferably constructed of copper but may also be constructed of aluminum or any other suitable conducting metal.

It will be recognized by those skilled in the art that the number of anodes in the cell will usually correspond to the number of diaphragm coated cathodes in the cell. The electrodes are positioned in the cell alternately, generally in a vertical position, with one anode being next to and spaced apart from a cathode. The number of anodes in each row and the number of rows of anodes, which corresponds to the number of novel conducting means in each cell, is not critical. Generally, the number of anodes in a row may range from about 2 to about 50 and preferably from about 10 to about 35 anodes per row. The number of rows of anodes (or conducting means) may range from 1 to about 10 and preferably from about 6 rows of anodes per cell. In a cell of this type, chlorine is produced at the cathode, hydrogen is produced at the anode and collected separately.

The novel conducting means and anode connection of this invention may also be used in other electrolytic cells, such as the type where the diaphragm is omitted and the product is sodium chlorate, or in cells where the anode connections are through the side of the cell.

Advantages of using the novel conducting means and anode connection of this invention include the following:

a. The O-ring seal provides backup protection so that if the dished washer sealing means leaks, the O-ring still prevents the corrosive cell environment from escaping or attacking the anode post core and other components.
b. The novel split bar conductor means and clamping means permits rapid connection to the power source and good current distribution to the anodes.
c. There is a large area of copper to copper contact outside of the cell.
d. Independent means for tightening of the upper sealing means, which requires a mild tightening, and independent means for tightening of the copper to copper joints, which requires more severe tightening, are provided.
e. The cell is free of a copper conductor being brazed to the steel plate and therefore the difference in coefficient of expansion of copper and steel will not cause excess bowing of the steel plate and movement of the anode posts when variations in temperature occur.

The following Example is presented to illustrate the invention more fully.

EXAMPLE

A diaphragm cell of the type disclosed in U.S. Pat. No. 3,485,730 issued to C. W. Virgil, Jr. on Dec. 23, 1969, was modified to include the conducting means and anode attachment means described in FIG. 1.

A cell base having an overall dimension of 63 inches by 56¼ inches was constructed of a 1 inch steel plate coated with a ¼ inch thick hard rubber interior liner. Two series of anode post holes were drilled in the cell base. Each series of holes was positioned in a straight line equidistant and parallel to the center line of the base; about 14 inches from the center line and 28 inches from each other, the center line being perpendicular to the 63 inch side of the cell. Each series of holes contains 16 holes, the centers of which were approximately three inches apart, the last hole in each series being approximately 4¾ inches from the edge of the cell base. The diameter of each hole was about 1 21/32 inches.

A flanged sleeve constructed of hard rubber of about ¼ inch thick having a sleeve height of about 1¼ inches, a flange outside diameter of about 2½ inches, and an inside diameter of about 1 5/32 inches was placed into each cell base hole. The flanged portion was sealed to the interior surface of the upper layer and the sleeve portion was sealed to the wall of the cell base hole.

Thirty-two anodes were placed in these holes, each anode being comprised of a mesh portion secured to a central anode post having a dished washer welded to the lower portion of the anode post. The mesh poriton of each anode was approximately 24½ inches in width and 18¼ inches in height, being secured at the center of its short dimension to an anode post having a diameter of approximately 1⅛ inches. The length of these anode posts was approximately 27¾ inches and the upper edge of the mesh portion was located about ¾ inch from the top of the anode post.

Each anode post was constructed of a 1 inch diameter copper core clad with a 1/16 inch thick sheet of titanium on about the upper 22 15/16 portion of the anode post, leaving an O-ring recess of about 1/16 inch at the bottom of the cell base hole wall.

Each anode post had a titanium dished washer of about 2 inches outside diamter welded perpendicular thereto at a point about 21 inches from the top of the anode post. A neoprene washer having an outside diameter of 2⅜ inches and a thickness of about 3/16 inch placed on each anode post with the top of the washer below the dished washer on the anode post. The anode post was placed in a hole in one of the rows of holes in the cell base. The bottom of each neoprene washer rested on the upper surface of the flanged portion of the flanged sleeve. Each anode was placed parallel to each other and perpendicular to the above-mentioned center line. A neoprene O-ring having a 1 inch inside diameter and a 1 ⅛ inch outside diameter was placed in the O-ring recess formed between the bottom of the interior of the sleeve portion and the 1 inch diameter copper core of the anode post extending below the end of the clad titanium sheet.

A pair of split spaced-apart copper bars was secured to each row of anode posts below the cell base with the upper surface of the copper bars pressed against the bottom of the cell base and O-ring. Each copper bar had a height of about 2 inches, a width of about 1 inch, a length of about 54 inches, and had 16 rounded or semicircular grooves with a diameter of about 1 inch positioned vertically along the bar spaced about three inches between centers and corresponding to the location of the anode posts.

On one exterior side of the split bars in each pair, extending from the edge of the cell base, there was secured a copper leaf having a length of about 2 feet 11½ inches, and to the exterior of that leaf was secured a leaf having a length of about 1 foot 2¼ inches. On the exterior side of the other split bar were similarly secured a leaf having a length of about 1 foot 11½ inches and another leaf of about 7¾ inches in length. Each leaf was a copper bar having a width of about 1 inch and a height of about 2 inches. Each split pair of bars and the four leaves accompanying each pair were bolted together with a series of threaded bolts placed horizontally between each anode post. The centerlines of these horizontal bolts fall in a plane perpendicular to a plane through the centerline of the anode posts. The bolts were ⅝inch in diameter, the length varying according to the number of bars being secured together. Spring washers and threaded nuts were secured to the end of the threaded bolts and tightened until the round grooves firmly gripped the anode posts. A washer and threaded nut were placed on the end of each threaded anode post and tightened against the bottom of the split bars.

A bus bar attachment 10 inches by 10 inches was welded horizontally to the ends of the split bars and the four leaves of copper at the edge of the cell base. A bus bar was attached to the bus bar attachment for supplying current to the cell.

A cell can and top were secured to the cell base. Suspended from two sides of the cell can were 32 asbestos-coated steel mesh cathodes alternately spaced between and parallel to the anodes. Also secured to the exterior portion of the cell base were 3 I-beams in a horizontal position used as support 41. Each I-beam was 44¼ inches in length positioned parallel to the above-defined base center line about 6 inches from the edge of the cell base. The supports were positioned paralled to each other, one along the center line of the cell base and each of the others approximately 19½ inches between centers, and on opposite sides of the center line.

The cell is operated for extended periods with a minimum of maintenance and corrosion problems, and with a high chlorine yield.

What is claimed is:

1. An electrolytic diaphragm cell for the electrolysis of brine, comprising:

a. a laminated cell base having a non-metallic corrosion resistant upper layer secured to a lower metallic supporting layer and further having an exterior surface and an interior surface and a plurality of walls defining a plurality of holes communicating said interior and exterior surfaces;

b. a cell body secured to said cell base;

c. a plurality of diaphragm coated cathodes secured to said cell body;

d. a plurality of anodes, each having a metallic conductive surface;

e. a plurality of metal anode posts positioned in at least one straight row and extending through said holes of said cell base and secured to respective ones of said conducting surfaces;

f. at least one conducting means for each of said straight rows including at least one pair of spaced conductive bars having a series of pairs of adjacent grooves for receiving and being secured to each of said anode posts in at least one of said rows responsive to the securing of each of said pairs of bars together;

g. bus bar attachment means, secured to one end of said conducting means, for attaching a bus bar to said conducting means;

h. a plurality of conductor leaf means, secured to said conducting means in decreasing thicknesses from said bus bar attachment means to the opposite side of said cell base, for achieving a more uniform current distribution among said anode posts;

i. a flange secured to each of said anode posts at a position above said interior surface of said cell base, and j. a flanged sleeve, inserted into each of said holes of said cell base and lying between said anode post and said cell base, each of said sleeves having:

i. a lower sleeved portion exteriorly joined to one of said walls of said cell base, and ii. an upper flanged portion having a bottom joined to said interior surface.

2. The electrolytic diaphragm cell of claim 1 wherein a flexible upper sealing means is positioned between each of said flanges and the top of said upper flanged portion.

3. The electrolytic diaphragm cell of claim 2 wherein a flexible lower sealing means is positioned between the lower portion of each of said anode posts and the interior of said lower sleeve portion containing said anode post.

4. The electrolytic diaphragm cell of claim 3 wherein said non-metallic corrosion resistant upper layer and said flanged sleeve are each constructed of a material selected from the group consisting of hard rubber, polypropylene, acrylonitrile-butadiene-styrene polymers, polyester, polymerized fluorinated ethylene and mixtures thereof.

5. The electrolytic diaphragm cell of claim 4 wherein said upper non-metallic corrosion resistant layer and said flanged sleeve are each hard rubber and said lower metallic supporting layer is steel.

6. The electrolytic diaphragm cell of claim 5 wherein said flange on said anode post is a dished washer.

7. The electrolytic diaphragm cell of claim 6 wherein said upper sealing means and said lower sealing means are each constructed of a flexible material selected from the group consisting of polypropylene, neoprene, and fluorinaed ethylene.

8. The electrolytic diaphragm cell of claim 7 wherein said lower sealing means is at least one O-ring positioned in a recess formed between said anode post and the interior or said lower sleeve portion.

9. The electrolytic diaphragm cell of claim 8 wherein said conducting means is constructed of copper, each of said conducting means is secured to from about 10 to about 35 anode posts, and each of said electrolytic cell contains from about 1 to about 6 of said conducting means.

10. The electrolytic diaphragm cell of claim 9 wherein said anode posts and said grooves are round.

11. The electrolytic diaphragm cell of claim 10 wherein each of said anode posts has a lower threaded portion, and a threaded nut is secured to each of said lower portions below said conducting means.

12. The electrolytic diaphragm cell of claim 10 wherein each of said posts has a lower threaded portion and a threaded nut is secured to each of said lower threaded portions below said exterior surface of said cell and above said conducting means.

* * * * *